US005191278A

United States Patent [19]

Carpenter

[11] Patent Number: 5,191,278

[45] Date of Patent: Mar. 2, 1993

[54] HIGH BANDWIDTH LOW DROPOUT LINEAR REGULATOR

[75] Inventor: Brian A. Carpenter, Delaplane, Va.

[73] Assignee: International Business Machines Corporation, Armonk, N.Y.

[21] Appl. No.: 780,600

[22] Filed: Oct. 23, 1991

[51] Int. Cl.[5] ..... G05F 1/565

[52] U.S. Cl. ..... 323/275; 323/277; 323/280

[58] Field of Search ..... 323/273, 274, 275, 276, 323/277, 278, 280

[56] References Cited

U.S. PATENT DOCUMENTS 4,346,342 8/1982 Carollo .
4,390,833 6/1983 Tzeng .
4,423,369 12/1983 Alaspa et al. .
4,479,085 10/1984 Uchida et al. ..... 323/280
4,536,699 8/1985 Baker .
4,560,918 12/1985 Callen .
4,814,687 3/1989 Walker ..... 323/275
4,825,144 4/1989 Alberkrack et al. .
4,835,649 5/1989 Salerno .
4,841,219 6/1989 Lonergan .
4,881,023 11/1989 Perusse et al. .
4,933,625 6/1990 Hayakawa ..... 323/275

*Primary Examiner*—Emanuel T. Voeltz
*Attorney, Agent, or Firm*—Jesse L. Abzug; Joseph C. Redmond, Jr.

[57] ABSTRACT

A linear voltage regulator for regulating the voltage and current in a DC supply is described. The invention includes current and voltage sense elements. The outputs from the sensed elements are summed together as the gate input to an FET pass transistor which regulates the power supplied. The two feedback loops provide high bandwidth and improve dynamic response.

12 Claims, 3 Drawing Sheets

HIGH BANDWIDTH LOW DROPOUT LINEAR REGULATOR

BACKGROUND INFORMATION

1. Field of the Invention

This invention relates to voltage regulation in a DC power supply. In particular, a high bandwidth, low dropout linear regulator for use in highly dynamic load environments is disclosed.

2. Background of the Invention

State of the art circuits, such as CMOS VLSI technology have proven to be extremely dynamic loads. It is not unusual for such circuits to exceed steady state operating current by over 100% during switching. Placing these circuits in centralized power systems is not feasible because the voltage at these integrated circuits will drop beyond their specified operating range due to inductive losses in the power distribution.

Conventional solutions include putting a linear regulator on a circuit card. This solution, however, requires a 2.5 volt drop across the regulator, resulting in power dissipation in excess of than 12.5 watts for a 2.5 volt drop. Low dropout regulators reduce the voltage loss to about 1 volt and power dissipation of 5 watts.

This solution, however, is not satisfactory because commercially available linear regulators have a low bandwidth. As a result, the dynamic response of the power supply is inadequate. A typical regulator, such as a Model 7805 (5 volts, 1 amp) has a 600 mV drop for a 500 mA step load, and its output impedance is greater than 1 ohm above 50 KHz.

It is desirable to have a linear regulator with the following characteristics:

1) wide bandwidth to decrease the amount of external filtering required to meet dynamic load requirements and improve load rejections;
3) scalable with respect to current and parallelable for large loads; and
4) capable of being integrated into an application specific integrated circuit (ASIC) for power applications.

OBJECTS OF THE INVENTION

It is therefore an object of the present invention to provide a linear regulator circuit capable of meeting dynamic load requirements.

It is a further object of the present invention to provide a linear regulator having a wide bandwidth.

It is still another object of the present invention to provide a linear regulator having low dropout voltage to improve system efficiency and reduce thermal stresses.

It is another object of the present invention to provide a linear regulator scalable with respect to current and parallelable for large loads.

It is a further object of the present invention to provide a linear regulator that can be integrated into a power application specific integrated circuit.

SUMMARY OF THE INVENTION

These objects and other advantages to become apparent, are achieved by the high bandwidth low dropout linear regulator circuit described herein. The invention incorporates into linear regulator design many recent advances in semiconductor and switching regulator control. Load current and voltage are continuously monitored. Control is provided via two separate feedback loops to a summer. The output from the summer is provided as the control signal to the gate of a pass device, which regulates the flow of current from a power source.

DESCRIPTION OF THE PREFERRED EMBODIMENT

Figure 1:
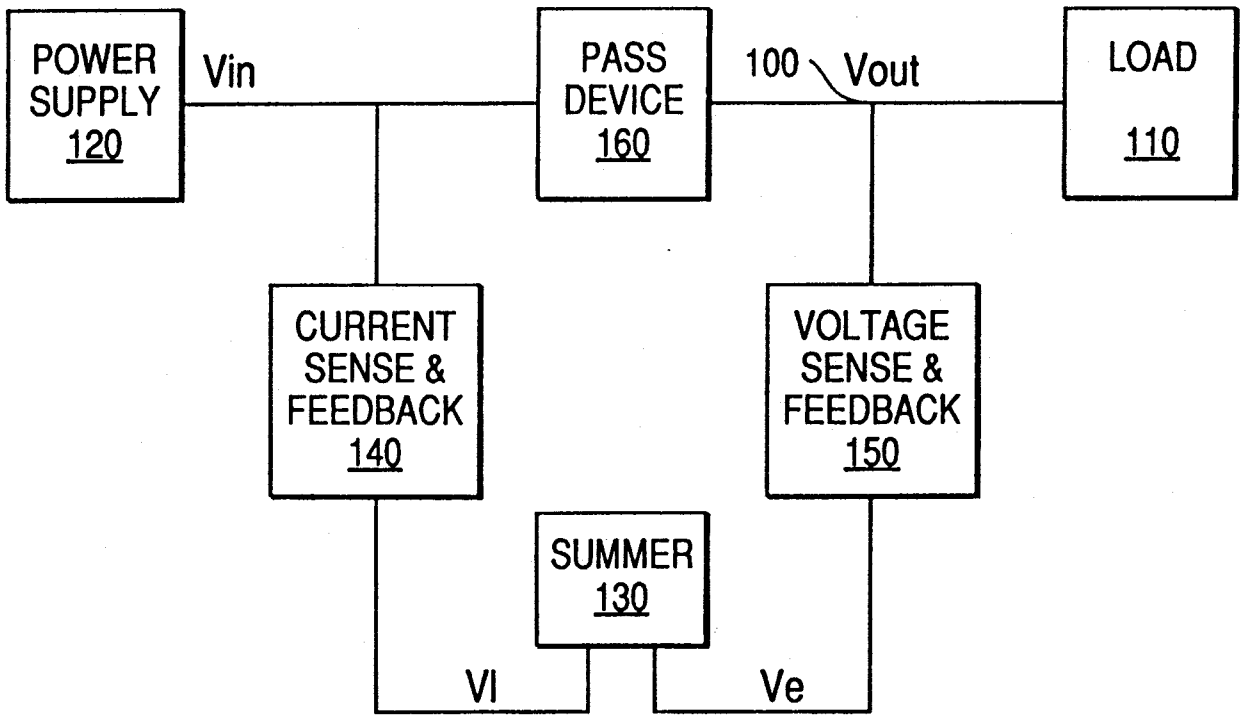
FIG. 1 shows a block diagram of the regulator circuit.

Referring to FIG. 1, the primary objective of the invention is to maintain a constant Vout at point 100, regardless of the magnitude of the load 110. Power source 120, which provides the input voltage Vin, can be any type of power supply as currently known in the art.

The advantages over the prior art are obtained by providing two feedback voltages to a summer 130. The current sense and feedback loop represented by block 140, provides as its output a voltage Vi directly proportional to the current being drawn by load 110. The second input to the summer 130 comes from a voltage sense and feedback loop represented by block 150. Block 150 provides a voltage directly proportional to the difference between Vout and a fixed reference voltage. The output from summer 130 gates a pass device 160, which essentially provides a resistance inversely proportional to the voltage applied at its gate. The net result is that when either or both of the current feedback and voltage feedback inputs to summer 130 increases, the voltage out of summer 130 increases and the resistance through the pass device 160 decreases, thereby allowing an increased flow of current through the pass device which keeps Vout at its desired level.

Figure 2:
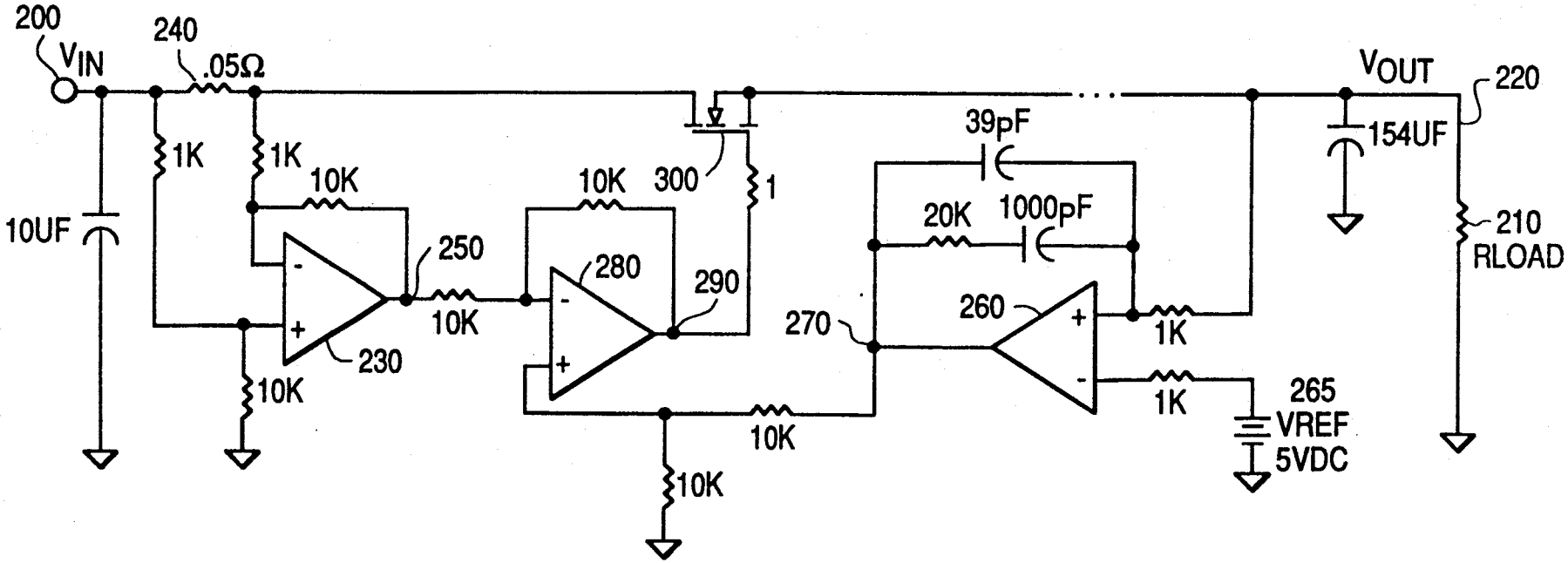
FIG. 2 shows a schematic for a first embodiment of the invention.

A circuit implementing the function described in FIG. 1 is schematically illustrated in FIG. 2. Vin is supplied at point 200. The voltage output to the load, represented by resistor 210, is Vout at point 220. The current sensing function is performed by operational amplifier 230. Op amp 230 measures the voltage differential across resistor 240, which is proportional to the current flowing through it. Op amp 230 provides a 10× gain to the voltage differential output at point 250.

The voltage sensing is provided by op amp 260, which measures the potential difference between Vout at point 220 and VREF 265. The output from op amp 260 at point 270 is a voltage proportional to the difference between Vout and VREF. As Vout falls below VREF, the output voltage at 270 increases.

The output 250 from op amp 230 and the output 270 from op amp 260 are the negative and positive inputs respectively to op amp 280, used as a summing amplifier. If either or both of the voltages at points 250 and 270 increase, then the output from op amp 280 at point 290 increases.

The output 290 is the gate input of MOSFET pass transistor 300. MOSFET transistor 300 can be an Intermediate Range Frequency Device (IRFD) device available from International Rectifier and other sources. The drain of MOSFET 300 is connected to Vin 200 and the source is connected to Vout at point 220.

Figure 3:
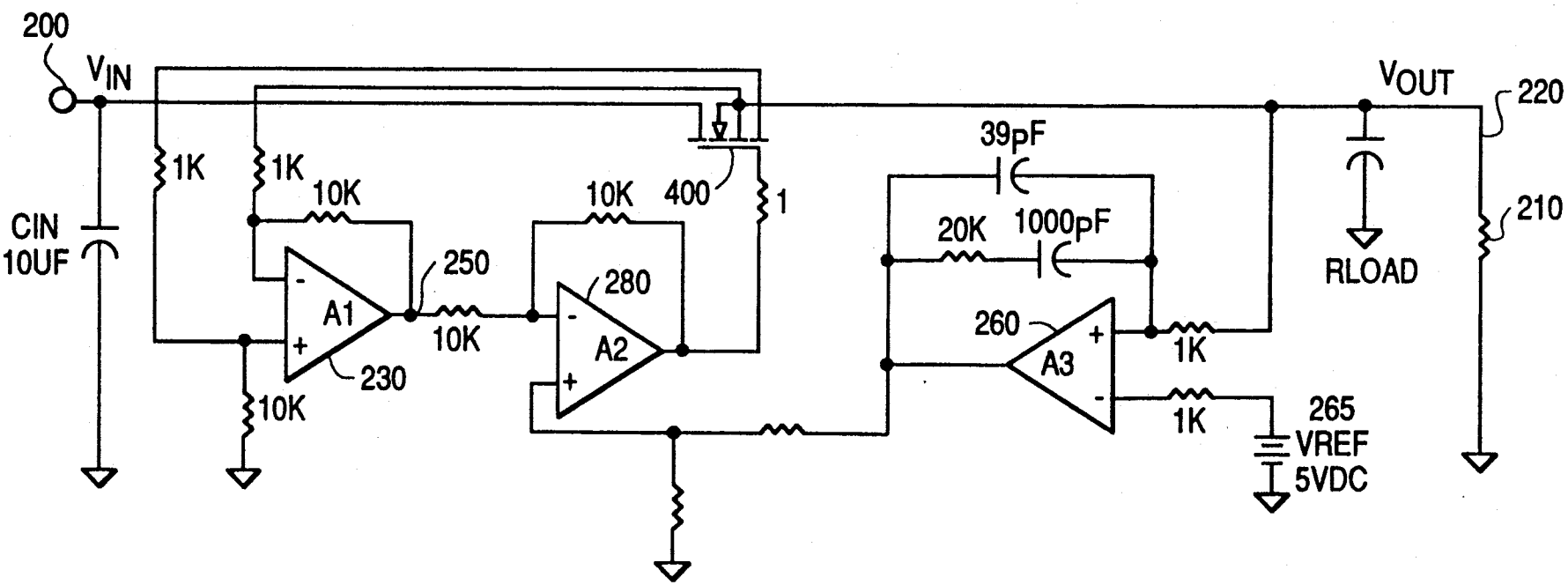
FIG. 3 show a schematic diagram of an alternative embodiment of the invention.

FIG. 3 shows an alternate embodiment of the invention in which the current sensing resistor (240 in FIG. 2) is integrated into the pass transistor 400. Pass transistor 400 is an HEXSense-Current Sense IRCZ44 Power MOSFET available from International Rectifier. The remainder of the circuit would remain the same.

In actual practice, the inventive circuit could be integrated into an ASIC, of it could be on a separate chip if desired. Also, the operational amplifiers, which in the preferred embodiment are all LM6361 op amps available from National Semiconductor could be replaced with other op amps as generally known in the art. The resistance and capacitance value shown in the Figures can be modified to achieve performance as desired.

To summarize the advantages provided by this invention, prior voltage regulators had the loop bandwidth constrained by the load capacitance and voltage loop compensation capacitance and amplifier. The phase shift (90 degrees for each capacitor and 180 degrees for the inverting amplifier) caused single loop systems to oscillate as the bandwidth was pushed higher and higher because eventually the sum of the phase shifts was 360 degrees. If there was still gain at the point, the regulator oscillated.

This invention provides a current loop bandwidth that is always greater than the voltage loop bandwidth. The stability of the two loop system is dependent on the sum of the voltage loop and the current loop; since the current loop bandwidth is greater, the stability characteristics are determined by the current loop. As can be seen in FIGS. 2 and 3, the current loop has no external compensation. The only reactive element is the output capacitor. Thus, the current loop can have no more than a 90 degree phase shift, and it will always be stable. As a result, a designer can push the voltage loop bandwidth very high (>2 MHz to get the ideal "zero impedance" voltage loop response at high frequencies without stability problems. The high bandwidth provides the extremely fast and precise dynamic load response.

While the invention has been described with reference to two alternative embodiments, it will be understood by those skilled in the art that variations to the circuit could be made without departing from the spirit and scope of the invention. Accordingly, the scope of the invention shall only be limited as specified in the following claims.

I claim:

1. A linear regulator circuit for controlling the voltage applied from a power source to a load comprising:

a single reference voltage;

means, including a circuit element for sensing the current drawn by the load and generating a voltage across the circuit element proportional to the current, said current sensing means having an input connected to the source and, providing a first voltage output;

means for sensing voltage across the load said voltage sensing means having a first input connected to the load and a second input connected to the single reference source and providing a second voltage output;

means for summing the first and second voltage outputs from the current and voltage sensing means and providing a third output signal;

means for switching the first and second outputs as a function of frequency of the voltage sensing and current sensing means; and means for regulating a power source, said regulating means responsive to the output of said summing means, whereby changes in the current drawn or voltage across a load change the resistance of said regulating means.

2. The linear regulator circuit as claimed in claim 1 wherein the regulating means is an FET pass device.

3. The regulator as claimed in claim 1 wherein said sensing means include operational amplifiers.

4. The circuit as claimed in claim 1 wherein said summing means include an operational amplifier.

5. The circuit as claimed in claim 1 wherein said regulating means and said current sensing means are integrated into a single integrated circuit.

6. The circuit of claim 1 wherein the voltage sensing means compares the voltage sensed across the load to the single reference voltage.

7. In a power supply for providing a voltage and current source to an electronic circuit, a circuit for regulating the voltage and current provided in the electronic circuit comprising:

a single reference voltage;

means for sensing the current drawn by the load and generating a voltage proportional to the load current, said current sensing means having an input across a resistor connected to the source and providing a first voltage output;

means for sensing the voltage across the load and generating a voltage proportional to the voltage across the load, said voltage sensing means having a first input connected to the load and a second input connected to the single reference voltage and providing a second voltage output;

means for summing the first and second voltage outputs from the current and voltage sensing means, respectively and providing an output signal;

means for switching the first and second outputs as a function of frequency of the voltage sensing and current sensing means; and means for regulating a power source, said regulating means responsive to the output of said summing means, whereby changes in the current drawn or voltage across a load change the resistance of said regulating means.

8. The linear regulator circuit as claimed in claim 7 wherein the regulating means is an FET pass device.

9. The regulator as claimed in claim 7 wherein said sensing means include operational amplifiers.

10. The circuit as claimed in claim 7 wherein said summing means include an operational amplifier.

11. The circuit as claimed in claim 7 wherein said regulating means and said current sensing means are integrated into a single integrated circuit.

12. A high bandwidth, low dropout linear regulator for controlling the voltage applied from a power source to a load comprising:

a single reference voltage, means including a first differential amplifier for sensing a voltage differential across a circuit element, which differential is proportional to the current drawn by the load, and providing a low constant gain to the voltage differential over a large bandwidth as a first output voltage, means, including a second operational amplifier connected between the single reference voltage and the load for sensing the voltage across the load and providing a second voltage output, the amplifier having a first bandwidth at low frequencies which decreases with frequency so as to cross unity gain before the first amplifier crosses unity gain as a second output voltage, means including a third operational amplifier for summing the first and second outputs and providing an increased third output voltage for increased current in the current sensing loop and reduced second output voltages, means for switching the first and second outputs as a function of frequency of the voltage sensing and current sensing means; and regulating means responsive to the third output for providing constant load voltages through large dynamic load current changes across a wide bandwidth and having a low dropout voltage.

* * * * *